US007972479B2

(12) United States Patent
Gane et al.

(10) Patent No.: US 7,972,479 B2
(45) Date of Patent: Jul. 5, 2011

(54) PROCESS FOR THE CONTROL OF PITCH

(75) Inventors: Patrick A. C. Gane, Rothrist (CH); Joachim Schölkopf, Killwangen (CH); Daniel Gantenbein, Gempen (CH)

(73) Assignee: Omya Development AG, Oftringen (CH)

( * ) Notice: Subject to any disclaimer, the term of this patent is extended or adjusted under 35 U.S.C. 154(b) by 0 days.

(21) Appl. No.: 12/449,911

(22) PCT Filed: Mar. 19, 2008

(86) PCT No.: PCT/EP2008/053335

§ 371 (c)(1), (2), (4) Date: Nov. 13, 2009

(87) PCT Pub. No.: WO2008/113839

PCT Pub. Date: Sep. 25, 2008

(65) Prior Publication Data

US 2010/0051216 A1 Mar. 4, 2010

(30) Foreign Application Priority Data

Mar. 21, 2007 (EP) ..... 07005853

(51) Int. Cl.
*D21F 13/00* (2006.01)

(52) U.S. Cl. ..... 162/199; 162/48; 162/72; 162/90; 162/181.2; 210/908; 210/928

(58) Field of Classification Search ..... 162/48, 162/72, 90, 181.2, 199; 210/263, 501.1, 210/502.1, 503–509, 702, 723, 908, 928
See application file for complete search history.

(56) References Cited

U.S. PATENT DOCUMENTS

| | | | |
|---|---|---|---|
| 6,210,526 | B1 | 4/2001 | Pohlen |
| 2004/0020410 | A1 | 2/2004 | Gane |
| 2006/0048908 | A1 | 3/2006 | Wang et al. |

FOREIGN PATENT DOCUMENTS

| | | | |
|---|---|---|---|
| EP | 0 989 229 | A1 | 3/2000 |
| WO | WO 2004/083316 | A | 9/2004 |

OTHER PUBLICATIONS

The International Search Report for PCT Application No. PCT/EP2008/053335.

The Written Opinion of the International Searching Authority for PCT Application No. PCT/EP2008/053335.

*Primary Examiner* — Eric Hug
*Assistant Examiner* — Peter Chin
(74) *Attorney, Agent, or Firm* — Amster, Rothstein & Ebenstein LLP

(57) ABSTRACT

The present invention relates to a process for the control of pitch in an aqueous medium by adding surface-reacted natural calcium carbonate or an aqueous suspension comprising surface-reacted calcium carbonate and having a pH greater than 6.0 measured at 20° C., to the medium, wherein the surface-reacted calcium carbonate is a reaction product of natural calcium carbonate with carbon dioxide and one or more acids, the use of the surface-reacted natural calcium carbonate for pitch control, as well as to a combination of a surface-reacted natural calcium carbonate and talc for pitch control, and the resulting composites.

51 Claims, 5 Drawing Sheets

PROCESS FOR THE CONTROL OF PITCH

This is a U.S. national phase of PCT Application No. PCT/EP2008/053335, filed Mar. 19, 2008, which claims the benefit of European Application No. 07005853.2, filed Mar. 21, 2007.

The present invention relates to a process for the control of pitch, to the use of a surface-reacted natural calcium carbonate for pitch control, as well as to a combination of a surface-reacted natural calcium carbonate with talc and a composite of surface-reacted calcium carbonate and pitch, optionally comprising talc.

In the paper industry, very often "pitch problems" occur, reported mainly as a deposition of organic sticky material coming out of water suspension either onto the papermaking equipment or as spots in the paper web itself.

The primary fibre source in papermaking is wood, which is reduced to its constituent fibres during pulping by combinations of grinding, thermal and chemical treatment. During this process the natural resin contained within the wood is released into the process water in the form of microscopic droplets. These droplets are referred to as pitch. Problems arise when colloidal pitch becomes destabilised from the original emulsion form and is deposited on the surfaces in the wet-end circuit of a paper mill, where the particles can form agglomerates, which eventually break loose and appear as visible spots in the paper, ranging from yellow to black in colour.

The chemical composition of pitch is generally divided into four classes of lipophilic components: i) fats and fatty acids, ii) steryl esters and sterols, iii) terpenoids, and iv) waxes. The chemical composition depends on the fibre source, such as variety of tree, and on the seasonal growth from which the sample is produced. These lipophilic pitch compounds can be stabilised by the presence of ligno sulphonates and polysaccharides.

The formation of pitch can be described conceptually as developing via three main mechanisms. The first mechanistic route is the formation of an organic film of material, which can be transparent or translucent. Its thickness varies according to its concentration and the film needs a nucleus to form an initial coalescence. This type of pitch, as its formation mechanism suggests, is called filmy. The second type of pitch is one that is able to coagulate and form globules of 0.1-1.0 μm diameter, and thus is termed globular pitch. The third formation type of pitch commonly developed is an agglomerated, or pitch ball form and is often noticed in systems having the greatest problems with pitch deposition. The balls formed are of 1-120 μm diameter. In the filmy or globular state, the pitch does not generally cause problems, but once agglomerates have been formed then paper quality problems start to occur.

The pitchy nature of wood can be highly dependent on the season, the freshness of the wood chips, and the kind of pulping treatment. The situation can be tricky, since the highest tackiness usually is associated with an intermediate condition between liquid-like nature and solid-like nature. These characteristics are affected by temperature, the presence of other materials such as oils and resins, and by pH. The hardness ions, calcium and especially magnesium, often are associated with high levels of tackiness. Polymerization of wood pitch can shift the glass transition temperature of the material, so the maximum in tackiness is also shifted to a higher temperature.

Today, increasingly, papermaking pH is either neutral or slightly alkaline, such that the removal of pitch is no longer an automatic corollary of the use of alum, and other adsorbing materials such as talc are playing an even more important role in its control. The increase in pH to pseudo-neutral is a growing trend in mechanical papers and so the study of pitch removal under these conditions is also of growing importance. Moreover, mechanical pulps carry over much more dissolved and colloidal matter than chemical pulps and recycled pulps.

Talc is accepted as a very effective control agent for pitch deposits, and recent work suggests that talc controls the build-up of deposits by a detackification mechanism. The action of talc in controlling pitch, however, is not exactly established. It is assumed that talc reduces the tackiness of pitch-like materials or stickies so that they have less tendency to form agglomerates or deposit onto papermaking equipment or create spots in the product. Also, the function of talc is to reduce tackiness of materials that already have deposited, so that further accumulation of tacky materials on those surfaces is slowed down. Hereby it is important to add enough talc so that the overall tackiness of the surfaces in the system is reduced.

One problem with talc however is that if not enough talc is used, it tends to be merely incorporated into deposits and agglomerates of tacky materials. Furthermore, talc is known essentially to adsorb non-polar species.

Therefore, there is a continuous need for alternative materials, which provide a better performance than talc, and which also are capable of adsorbing polar and charged species.

The above object has been solved by a process for the control of pitch in an aqueous medium, wherein surface-reacted natural calcium carbonate or an aqueous suspension comprising surface-reacted calcium carbonate (SRCC) and having a pH of greater than 6.0 measured at 20° C., is added to the medium, wherein the surface-reacted calcium carbonate is a reaction product of natural calcium carbonate with carbon dioxide and one or more acids.

The surface-reacted natural calcium carbonate to be used in the process of the present invention is obtained by reacting a natural calcium carbonate with an acid and with carbon dioxide, wherein the carbon dioxide is formed in situ by the acid treatment and/or is supplied from an external source.

Preferably, the natural calcium carbonate is selected from the group comprising marble, chalk, calcite, dolomite, limestone and mixtures thereof.

In a preferred embodiment, the natural calcium carbonate is ground prior to the treatment with an acid and carbon dioxide. The grinding step can be carried out with any conventional grinding device such as a grinding mill known to the skilled person.

The surface-reacted natural calcium carbonate to be used in the process of the present invention is prepared as an aqueous suspension having a pH of having a pH measured at 20° C., of greater than 6.0, preferably greater than 6.5, more preferably greater than 7.0, even more preferably greater than 7.5. As will be discussed below, the surface-reacted natural calcium carbonate can be brought into contact with the aqueous medium by adding said aqueous suspension thereto. It is also possible to modify the pH of the aqueous suspension prior to its addition to the aqueous medium, e.g. by dilution with additional water. Alternatively, the aqueous suspension can be dried and the surface-reacted natural calcium carbonate brought into contact with the water is in powder form or in the form of granules. In other words, the increase of pH to a value of greater than 6.0 subsequent to treatment with an acid and carbon dioxide is needed to provide the surface-reacted calcium carbonate having the beneficial adsorption properties described herein.

In a preferred process for the preparation of the aqueous suspension, the natural calcium carbonate, either finely divided, such as by grinding, or not, is suspended in water.

Preferably, the slurry has a content of natural calcium carbonate within the range of 1 wt.-% to 80 wt.-%, more preferably 3 wt.-% to 60 wt.-%, and even more preferably 5 wt.-% to 40 wt.-%, based on the weight of the slurry.

In a next step, an acid is added to the aqueous suspension containing the natural calcium carbonate. Preferably, the acid has a $pK_a$ at 25° C. of 2.5 or less. If the $pK_a$ at 25° C. is 0 or less, the acid is preferably selected from sulphuric acid, hydrochloric acid, or mixtures thereof. If the $pK_a$ at 25° C. is from 0 to 2.5, the acid is preferably selected from $H_2SO_3$, $HSO_4^-$, $H_3PO_4$, oxalic acid or mixtures thereof.

The one or more acids can be added to the suspension as a concentrated solution or a more diluted solution. Preferably, the molar ratio of the acid to the natural calcium carbonate is from 0.05 to 4, more preferably from 0.1 to 2.

As an alternative, it is also possible to add the acid to the water before the natural calcium carbonate is suspended.

In a next step, the natural calcium carbonate is treated with carbon dioxide. If a strong acid such as sulphuric acid or hydrochloric acid is used for the acid treatment of the natural calcium carbonate, the carbon dioxide is automatically formed. Alternatively or additionally, the carbon dioxide can be supplied from an external source.

Acid treatment and treatment with carbon dioxide can be carried out simultaneously which is the case when a strong acid is used. It is also possible to carry out acid treatment first, e.g. with a medium strong acid having a $pK_a$ in the range of 0 to 2.5, followed by treatment with carbon dioxide supplied from an external source.

Preferably, the concentration of gaseous carbon dioxide in the suspension is, in terms of volume, such that the ratio (volume of suspension):(volume of gaseous $CO_2$) is from 1:0.05 to 1:20, even more preferably 1:0.05 to 1:5.

In a preferred embodiment, the acid treatment step and/or the carbon dioxide treatment step are repeated at least once, more preferably several times.

Subsequent to the acid treatment and carbon dioxide treatment, the pH of the aqueous suspension, measured at 20° C., naturally reaches a value of greater than 6.0, preferably greater than 6.5, more preferably greater than 7.0, even more preferably greater than 7.5, thereby preparing the surface-reacted natural calcium carbonate as an aqueous suspension having a pH of greater than 6.0, preferably greater than 6.5, more preferably greater than 7.0, even more preferably greater than 7.5. If the aqueous suspension is allowed to reach equilibrium, the pH is greater than 7. A pH of greater than 6.0 can be adjusted without the addition of a base when stirring of the aqueous suspension is continued for a sufficient time period, preferably 1 hour to 10 hours, more preferably 1 to 5 hours.

Alternatively, prior to reaching equilibrium, which occurs at a pH greater than 7, the pH of the aqueous suspension may be increased to a value greater that 6 by adding a base subsequent to carbon dioxide treatment. Any conventional base such as sodium hydroxide or potassium hydroxide can be used.

With the process steps described above, i.e. acid treatment, treatment with carbon dioxide and, preferably, pH adjustment, a surface-reacted natural calcium carbonate is obtained having good adsorption properties for several pitch species.

Further details about the preparation of the surface-reacted natural calcium carbonate are disclosed in WO 00/39222 and US 2004/0020410 A1, where it is described as a filler for the paper manufacture, the content of these references herewith being included in the present application.

In a preferred embodiment of the preparation of the surface-reacted natural calcium carbonate, the natural calcium carbonate is reacted with the acid and/or the carbon dioxide in the presence of at least one compound selected from the group consisting of silicate, silica, aluminium hydroxide, earth alkali aluminate such as sodium or potassium aluminate, magnesium oxide, or mixtures thereof. Preferably, the at least one silicate is selected from an aluminium silicate, a calcium silicate, or an earth alkali metal silicate. These components can be added to an aqueous suspension comprising the natural calcium carbonate before adding the acid and/or carbon dioxide. Alternatively, the silicate and/or silica and/or aluminium hydroxide and/or earth alkali aluminate and/or magnesium oxide component(s) can be added to the aqueous suspension of natural calcium carbonate while the reaction of natural calcium carbonate with an acid and carbon dioxide has already started. Further details about the preparation of the surface-reacted natural calcium carbonate in the presence of at least one silicate and/or silica and/or aluminium hydroxide and/or earth alkali aluminate component(s) are disclosed in WO 2004/083316, the content of this reference herewith being included in the present application.

The surface-reacted natural calcium carbonate can be kept in suspension, optionally further stabilised by a dispersant. Conventional dispersants known to the skilled person can be used. A preferred dispersant is polyacrylic acid.

Alternatively, the aqueous suspension described above can be dried, thereby obtaining the surface-reacted natural calcium carbonate in the form of granules or a powder.

In a preferred embodiment, the surface-reacted natural calcium carbonate has a specific surface area of from 5 $m^2/g$ to 200 $m^2/g$, more preferably 20 $m^2/g$ to 80 $m^2/g$ and even more preferably 30 $m^2/g$ to 60 $m^2/g$, e.g. 43 $m^2/g$, measured using nitrogen and the BET method according to ISO 9277.

Furthermore, it is preferred that the surface-reacted natural calcium carbonate has a mean grain diameter of from 0.1 to 50 μm, more preferably from 0.5 to 25 μm, even more preferably 0.8 to 20 μm, particularly 1 to 10 μm, e.g. 4 to 7 μm measured according to the sedimentation method. The sedimentation method is an analysis of sedimentation behaviour in a gravimetric field. The measurement is made with a Sedigraph™ 5100 of Micromeritics Instrument Corporation. The method and the instrument are known to the skilled person and are commonly used to determine grain size of fillers and pigments. The measurement is carried out in an aqueous solution of 0.1 wt % $Na_4P_2O_7$. The samples were dispersed using a high speed stirrer and supersonic.

In a preferred embodiment, the surface-reacted natural calcium carbonate has a specific surface area within the range of 15 to 200 $m^2/g$ and a mean grain diameter within the range of 0.1 to 50 μm. More preferably, the specific surface area is within the range of 20 to 80 $m^2/g$ and the mean grain diameter is within the range of 0.5 to 25 μm. Even more preferably, the specific surface area is within the range of 30 to 60 $m^2/g$ and the mean grain diameter is within the range of 0.7 to 7 μm.

In the process of the present invention, the surface-reacted calcium carbonate is added to the pitch containing aqueous medium by any conventional feeding means known to the skilled person. The surface-reacted natural calcium carbonate can be added as an aqueous suspension, e.g. the suspension described above. Alternatively, it can be added in solid form, e.g. in the form of granules or a powder or in the form of a cake. Within the context of the present invention, it is also possible to provide an immobile phase, e.g. in the form of a cake or layer, comprising the surface-reacted natural calcium carbonate, the aqueous medium running through said immobile phase. This will be discussed in further detail below.

In a preferred embodiment, the pH of the pitch containing aqueous medium is adjusted to a value of greater than 6.0, more preferably greater than 6.5, and even more preferably greater than 7.0 prior to the addition of surface-reacted calcium carbonate.

Preferably, the surface-reacted natural calcium carbonate is suspended in the pitch containing aqueous medium, e.g. by agitation means. The amount of surface-reacted natural calcium carbonate depends on the type of pitch or pitch species to be adsorbed. Preferably, an amount of 0.05-25 wt.-%, more preferably 0.25-10 wt.-% and most preferably 0.5-2 wt.-% based on the weight on oven (100° C.) dry fibers is added.

In the process of the present invention, the surface-reacted natural calcium carbonate is added to pitch containing aqueous media, such as mechanical pulp, e.g. ground wood, TMP (thermo mechanical pulp), or chemothermomechanical pulp (CTMP), as well as chemical pulp, e.g. kraft pulp or sulphate pulp, or recycled pulp used in the paper making process.

Pitch containing pulp which can be subjected to the process of the present invention particularly comes from wood pulp, which is the most common material used to make paper. Wood pulp generally comes from softwood trees such as spruce, pine, fir, larch and hemlock, but also some hardwoods such as eucalyptus and birch.

The pitch, which can be controlled according to the present invention may comprise such species as fats and fatty acids, steryl esters and sterols, terpenoids, and waxes. The chemical composition depends on the fibre source, such as variety of tree, and on the seasonal growth from which the sample is produced.

Optionally, additives can be added to the water sample to be treated. These might include agents for pH adjustment, etc.

In a preferred embodiment, a natural calcium carbonate which has not been surface-reacted as described above is added as well.

It has been found that a combination of the ionic/polar adsorption properties of surface-reacted calcium carbonate with the predominantly lipophilic properties of talc not only provides additive results, but synergistic effects regarding the adsorption of pitch.

Without wanting to be bound to a specific theory, it is believed that colloidal pitch adsorption depends on the relative roles of surface morphology and particle size in relation to the surface chemistry of both the mineral particles themselves and their selective adsorption dependence on the surface chemistry of the pitch.

SRCC is essentially characterized by its ability to adsorb a wide range of charged species such as saponified esters, etc., displaying relatively high surface area in respect to surface porosity, supporting the suggestion that a portion of the pitch, either individually or as a mixed surface, can be considered to display a Coulombic charge interaction. The hypothesis of mixed polar and non-polar surface energies of pitch is confirmed by the evidence of adsorption synergy when using SRCC in combination with talc.

Therefore, in an especially preferred embodiment of the present invention, additionally talc is added to the pitch containing aqueous medium.

Talcs which are useful in the present invention are any commercially available talcs, such as, e.g. talcs from Sotkamo (Finland), Three Springs (Australia), Haicheng (China), from the Alpes (Germany), Florence (Italy), Tyrol (Austria), Shetland (Scotland), Transvaal (South Africa), the Appalachians, California, Vermont and Texas (USA).

Depending on the origin of the coarse talc, there may be several impurities contained therein such as chlorite, dolomite and magnesite, amphibole, biotite, olivine, pyroxene, quartz and serpentine.

Preferred for the use in the present invention are talcs having a content of pure talc of >90 weight-%, for example >95 weight-% or >97 weight-% and up to >100 weight-%.

The talc particles used in the present invention may have a $d_{50}$, measured according to the sedimentation method as described above, in the range of 0.1 to 50 μm, e.g. 0.2 to 40 μm, preferably 0.3 to 30 μm, more preferably 0.4 to 20 μm, particularly 0.5 to 10 μm, e.g. 1, 4 or 7 μm.

The specific surface area of the talc can be between 3 and 100 $g/m^2$, preferably between 7 $g/m^2$ and 80 $g/m^2$ more preferably between 9 $g/m^2$ and 60 $g/m^2$, e.g. 51 $g/m^2$, especially between 10 and 50 $g/m^2$, for example 30 $g/m^2$.

Preferably, the talc is suspended together with the surface-reacted calcium carbonate in the pitch containing aqueous medium, e.g. by agitation means. The amount of talc depends on the type of pitch or pitch species to be adsorbed. Preferably, an amount of 0.05-25 wt.-%, more preferably 0.25-10 wt.-% and most preferably 0.5-2 wt.-% based on the weight on oven (100° C.) dry fibers is added.

The synergistic effects of SRCC/talc blends are given when the observed positive pitch adsorption value for the blend is greater than the added values of the pure minerals acting separately.

The occurrence of synergism depends on the specific surface area of the components and the composition of the pitch. The ratios, at which synergy occurs can however be easily determined by carrying out a test series with different ratios as described in detail in the examples.

After the adsorption is completed the composites of surface-reacted calcium carbonate, pitch and, optionally talc can be separated from the aqueous medium by conventional separation means known to the skilled person such as sedimentation and filtration.

In an alternative approach, the liquid to be purified is preferably passed through a permeable filter comprising the surface-reacted natural calcium carbonate and being capable of retaining, via size exclusion, the impurities on the filter surface as the liquid is passed through by gravity and/or under vacuum and/or under pressure. This process is called "surface filtration".

In another preferred technique known as depth filtration, a filtering aid comprising of a number of tortuous passages of varying diameter and configuration retains impurities by molecular and/or electrical forces adsorbing the impurities onto the surface-reacted natural calcium carbonate which is present within said passages, and/or by size exclusion, retaining the impurity particles if they are too large to pass through the entire filter layer thickness.

The techniques of depth filtration and surface filtration may additionally be combined by locating the depth filtration layer on the surface filter; this configuration presents the advantage that those particles that might otherwise block the surface filter pores are retained in the depth filtration layer.

One option to introduce a depth filtration layer onto the surface filter is to suspend a flocculating aid in the liquid to be filtered, allowing this aid to subsequently decant such that it flocculates all or part of the impurities as it is deposited on a surface filter, thereby forming the depth filtration layer. This is known as an alluvium filtration system. Optionally, an initial layer of the depth filtration material may be pre-coated on the surface filter prior to commencing alluvium filtration.

In view of the very good results of the surface-reacted calcium carbonate in pitch control as defined above, a further aspect of the present invention is the use thereof in pitch control as well as the use thereof in combination with talc as defined above providing synergistic effects.

The latter is particularly important in the case of very heterogenic pitch, where a lot of different species have to be removed. In such cases the use of a correspondingly selected combination of surface-reacted calcium carbonate and talc as described in the examples can be superior to using the different components alone.

Therefore, also the combination of surface-reacted calcium carbonate and talc as defined above is a further aspect of the present invention.

Finally, the composites of surface-reacted calcium carbonate as defined above and pitch adsorbed thereto are a further aspect of the invention, optionally also including talc as defined above.

In the examples, not only effectiveness of surface-reacted calcium carbonate, but also the synergy between surface-reacted calcium carbonate and talc is shown. Furthermore, the resulting pH was investigated. An increase in pH indicates that more esters are saponified resulting in more anionic species. Furthermore, it was found that the amount of cations remains at the same level at a reduced SCD (Streaming Current Detector Equivalency), indicating that the SRCC adsorbed anionic species. Whereas for talc the SCD remains at the same level, indicating that talc mostly adsorbed uncharged species.

The following figures, examples and tests will illustrate the present invention, but are not intended to limit the invention in any way.

EXAMPLES

A. Materials

1. Surface-Reacted Calcium Carbonate (SRCC)

A suspension of approximately 20 wt.-% based on the dry weight of finely divided natural calcium carbonate originating from Orney, France, was prepared. The slurry thus formed was then treated by slow addition of phosphoric acid at a temperature of approximately 55° C.

The resulting slurry had a BET specific surface area of 43 $m^2/g$ according to ISO standard 92777, and a $d_{50}$ of 1.5 μm measured by means of the Sedigraph™ 5100 from Micromeritics™.

Figure 1:
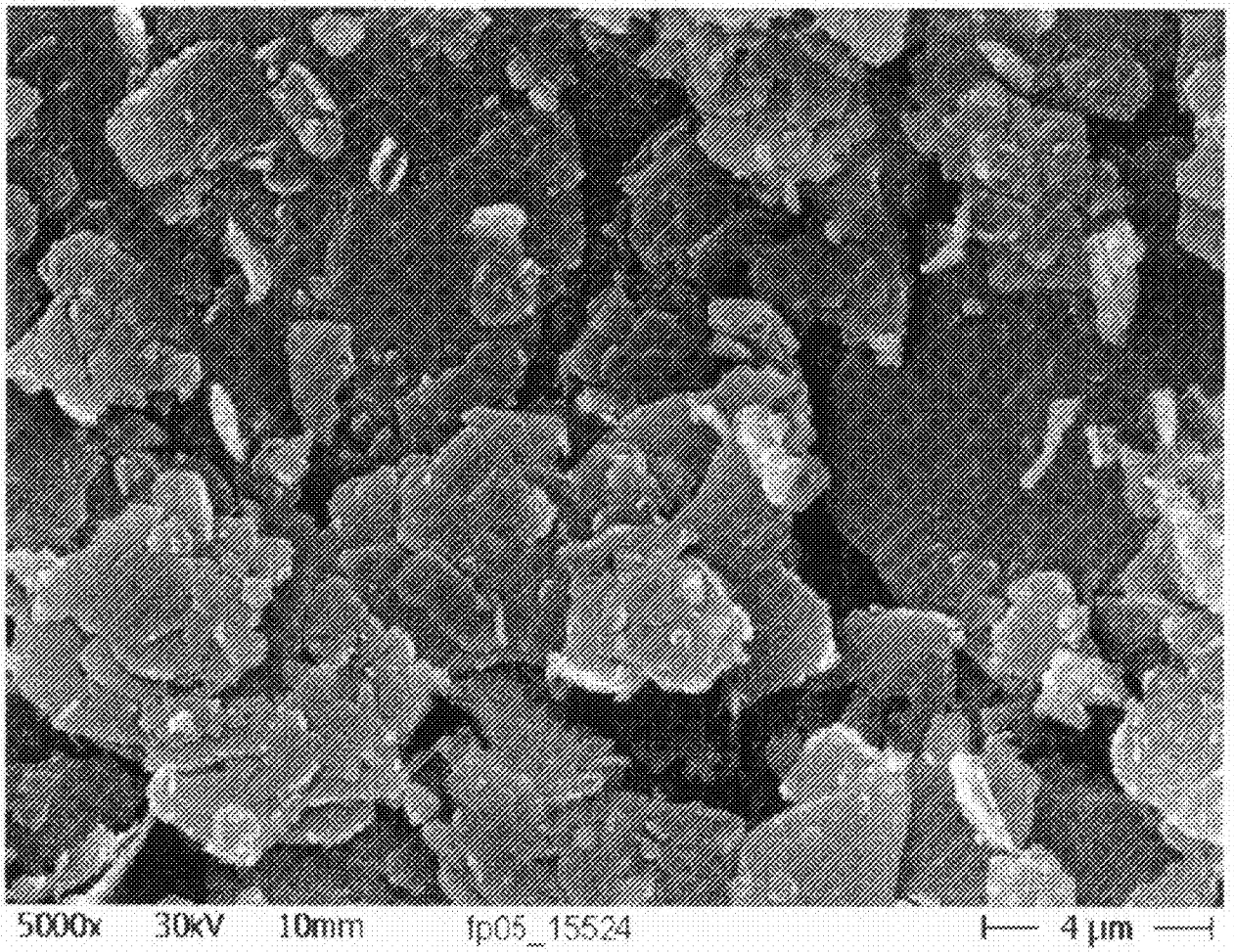
FIG. 1 is a SEM image of low specific surface area talc.

The surface-reacted calcium carbonate used in the present invention is shown in the SEM image of FIG. 1, illustrating its nano-modified surface consisting of high surface area rugosity distributed over the microparticle.

2. Talc

The talc powder of the present study are analysed both by X-ray fluorescence (XRF) [ARL 9400 Sequential XRF] and X-ray diffraction (XRD) [frpm 5-100° 2theta Bragg diffraction using a Bruker AXS D8 Advanced XRD system with CuKα radiation, automated divergence slits and a linear position-sensitive detector. The tube current and voltage were 50 mA and 35 kV, respectively: the step size was 0.02° 2 theta and the counting time 0.5 s per step].

The talc grade originated from Finland was a low specific surface area (FT-LSSA). It contains the minerals talc, chlorite and magnesite. The talc purity is about 97%, which was confirmed by FT-IR [Perkin Elmer Spectrum One Spectrometer] analyses and XRF.

It was ground with a jet-mill resulting in a BET specific surface area of 9 $m^2g^{-1}$ and a $d_{50}$ of 2.2 μm.

The mineral morphology is illustrated in FIG. 1 (FT-LSSA).

3. Pitch Containing Pulp 6.0 kg of the fresh wet pulp (3.7 w/w % solids content) were taken from the accept of the screen at a temperature of 90° C. before the bleaching step (peroxide bleaching) at an integrated pulp and paper mill in Switzerland in January 2006. The process water at the sampling position was only circulated in the TMP plant and duely contained no fillers. The thermo mechanical pulp thus obtained and used as a pitch source for the following experiments consists of 70 wt.-% spruce, the rest being composed of fir and a small part of pine. The pH of the pulp sample was between 6.7-6.8 at 25° C. The pulp was wet pressed through a filter of 2 μm pore size (filter paper, circular 602 EH).

A sample taken from the 5.0 liters of filtrate/liquor thus obtained was examined under a light microscope (Olympus AX-70) to check for fibrils, which, if present, might act negatively to distort pure adsorption results.

The zeta potential of the TMP filtrate was measured with a PenKem 500 device giving a value of −15 mV. This anionicity is an important factor when considering the adsorption potential of the charge collecting surface-reacted calcium carbonate. The total charge was determined by a streaming current detector (SCD) titration (Mütek PCD-02) and was found to be −0.45 $\mu Eqg^{-1}$ and the polyelectrolyte titration of the pulp filtrate gave −2.6 $\mu Eqg^{-1}$, where 1 Eq (equivalent) is the weight in grams of that substance, which would react with or replace one gram of hydrogen. Ion chromatography (Dionex DX 120 Ion-Chromatograph) of the TMP sample reports the following anions present in the TMP filtrate: $SO_4^{2-}$=256 ppm, $PO_4^{3-}$=33 ppm, $Cl^-$=20 ppm and $NO_3^{2-}$=2 ppm.

B. Methods 5 liters of the filtrate recovered from the thermo-mechanical pulp (TMP) (3.7 w/w %) filtered on a 2 μm filter were distributed into glass bottles; 200 g of filtrate in each bottle and 1 w/w % of talc or SRCC (dispersant-free slurry of 10 w/w %) was added to it. Then the bottles were closed and agitated for 2 hours. After 2 hours of agitation, the suspension was centrifuged for 15 minutes in a centrifuge (Jouan C 312, by IG Instruments) at a speed of 3500 rpm.

Two phases are collected: an upper liquid phase and a lower sedimented mineral-containing phase. A reference sample without mineral was used as a comparison. The upper liquid and the lower solid phase obtained after the centrifugation were separated and analysed by two measurements, according to the following:

Upper Liquid Phase—Gravimetry, Turbidity and Chemical Oxygen Demand COD

For a gravimetric analysis, a 100 $cm^3$ sample of the upper liquid aqueous phase was placed into a pre-weighed aluminium beaker and dried in an oven (90° C., 24 h) to get a total amount of non-volatile residue in the aqueous phase, i.e. any organic and inorganic material which was not adsorbed on the mineral surface.

A further 45 $cm^3$ sample was taken to analyse the turbidity caused by colloidal pitch particles unseparated minerals, by means of a NOVASINA 155 Model NTM-S (152). This instrument transmits light in the near infrared spectrum through an optical fibre probe where the emerging beam is scattered by small particles in suspension. Light scattered back at 180° is collected by parallel optical fibres in the probe and focused onto a photo-diode. The resulting signal is amplified and displayed directly in Nephelometric Turbidity Units (NTU), defined as the intensity of light at a specified wavelength scattered, attenuated or absorbed by suspended particles, at a method-specified angle from the path of the incident light, compared to a synthetic chemically prepared standard. Interference from ambient light is eliminated by the adoption of a modulated transmission signal, removing the need for light-tight sample handling systems.

A 2 $cm^3$ sample was also taken to make a chemical oxygen demand (COD) analysis, which gives a value for the total organic content, i.e. the non-adsorbed organic material. The COD analysis expresses the quantity of oxygen necessary for the oxidation of organic materials into $CO_2$ and was measured using a Lange CSB LCK 014, range 1000-10000 mg $dm^{-3}$ with a LASA 1/plus cuvette.

Lower Sedimented Mineral Phase—Thermo Gravimetric Analysis

Thermo gravimetric analysis was made with a scanning differential thermal analyser (SDTA 851$^e$) by Mettler Toledo, under constant heating rate of 20° C. $min^{-1}$ from 30° C. up to 1000° C. The loss under heating reflects the non-mineral components, present in the sediment. The results were compared with the pure mineral in order to determine the adsorbed species.

C. Results

It was found that the two different minerals have different adsorption behaviour when removing material out of the TMP filtrate, both in respect to colloidal and other species.

It was however, also found that there exist clear synergistic interactions between a low surface area talc (FT-LSSA) and SRCC.

To investigate these effects more closely, the separate activity of the minerals was studied in a series of experiments. Firstly, the TMP filtrate was treated, as mentioned above, either with the low surface area talc (FT-LSSA) or SRCC. Then, a second step was made using the TMP firstly treated with FT-LSSA and centrifuged, according to the previously described method, such that the upper liquid phase was treated a second time either with SRCC or again with the FT-LSSA.

a) pH

As a first step, the pH, streaming current detector equivalency (SCD), and the sodium/calcium balance were determined These measurements were made for the untreated TMP filtrate as a reference, a primary treatment with SRCC or FT-LSSA and a secondary treatment with the complementary mineral.

The resulting values are shown in table 3.

TABLE 3

| $1^{st}$ Treatment | $2^{nd}$ Treatment | SCD [$\mu Eqg^{-1}$] | pH | $Ca^{2+}$ [ppm] | $Na^+$ L [ppm] |
|---|---|---|---|---|---|
| TMP alone | — | −0.45 | 6.81 | 63 | 205 |
| SRCC | — | >−0.1 | 7.87 | 61 | 208 |
| FT-LSSA | — | −0.42 | 7.15 | 59 | 207 |
| FT-LSSA | +SRCC | <−0.1 | 8.04 | 61 | 210 |
| FT-LSSA | +FT-LSSA | −0.37 | 7.47 | 63 | 204 |

The pH became alkaline when the TMP filtrate was treated with SRCC and changed from about 6.8 to about 7.9 after the first primary treatment. When the TMP filtrate was treated with the low surface area talc the pH changed only a little from about 6.8 to about 7.2.

For the secondary treatment with SRCC, the pH in the liquid phase became again alkaline and was determined to be about 8.0. For the complementary secondary FT-LSSA treatment, the pH became again a little more alkaline, about 7.5.

These trends are not only due to the alkalinity of SRCC, but also show that potential acidic compounds such as fatty acids were adsorbed. An increase in pH indicates that more esters are saponified resulting in more anionic species.

b) Streaming Current Detector Equivalency (SCD)

SCD titration measures the total charged species in suspension. This was found to be −0.45 $\mu Eqg^{-1}$ for the TMP filtrate.

The talc treatment showed only a slight effect on this value. A strong effect was found for the SRCC treatment, for which the amount of anionic species was reduced to smaller than −0.1 $\mu Eqg^{-1}$, which shows the superior effect of using SRCC alone, and the improved effect of using a combination.

c) Sodium/Calcium Balance

Figure 2:
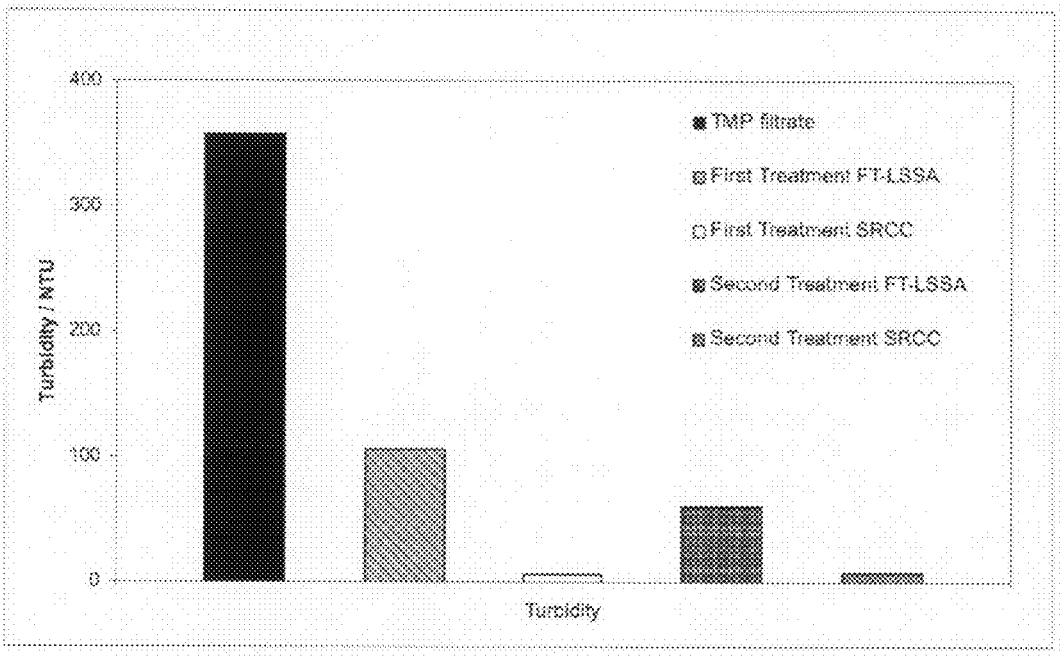
FIG. 2 illustrates the turbidity values for of the upper liquid phase of a TMP filtrate, of a TMP filtrate treated with FT-LSSA or SRCC alone, and with either FT-LSSA or SRCC subsequent to the treatment with FT-LSSA.
Figure 3:
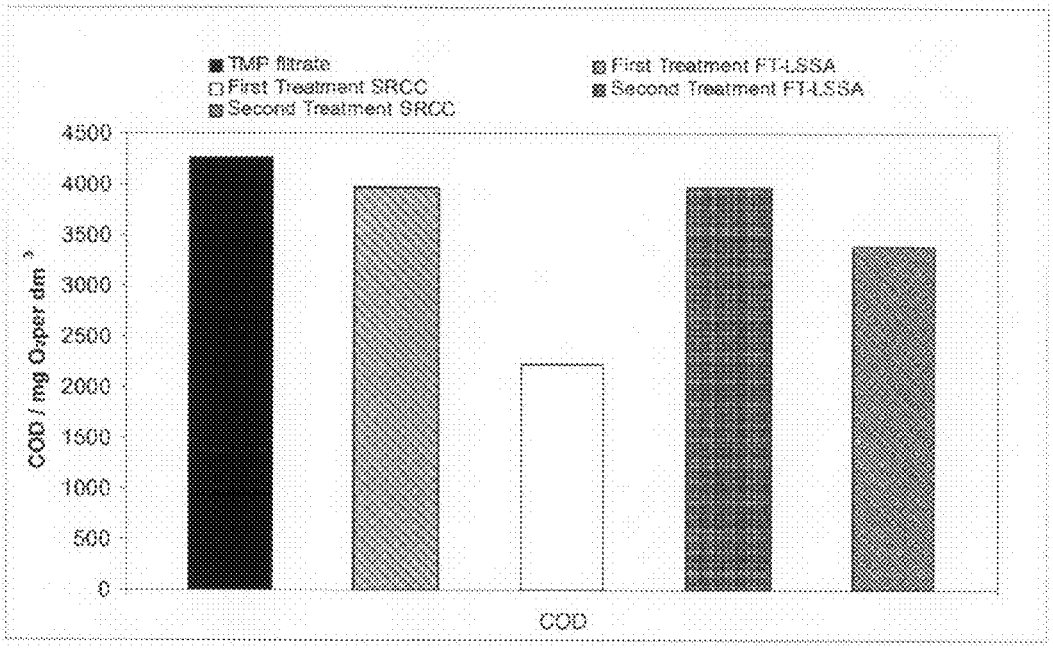
FIG. 3 illustrates the COD values for of the upper liquid phase of a TMP filtrate, of a TMP filtrate treated with FT-LSSA or SRCC alone, and with either FT-LSSA or SRCC subsequent to the treatment with FT-LSSA.
Figure 4:
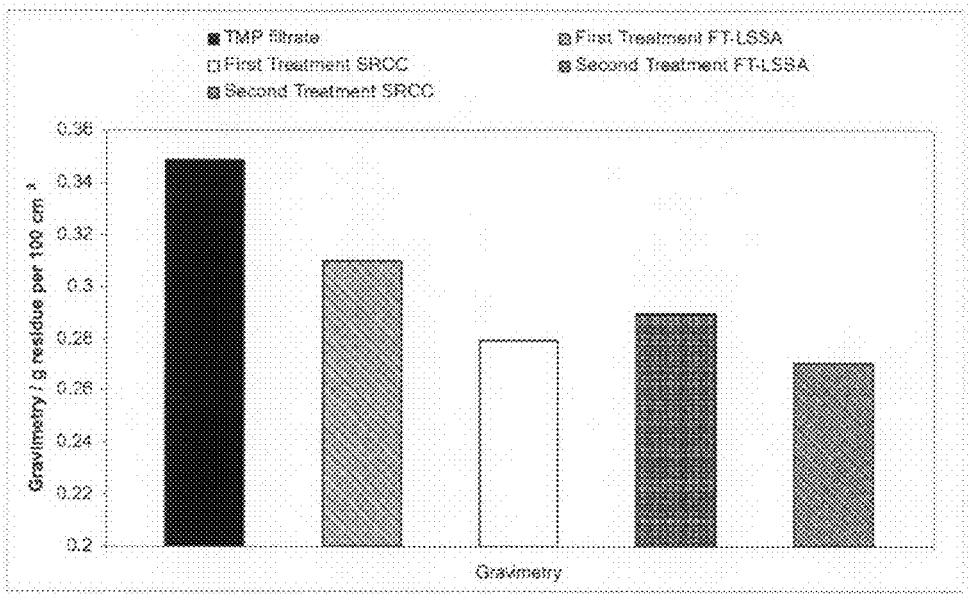
FIG. 4 illustrates the gravimetry values for of the upper liquid phase of a TMP filtrate, of a TMP filtrate treated with FT-LSSA or SRCC alone, and with either FT-LSSA or SRCC subsequent to the treatment with FT-LSSA.

Finally, the ion balance did not show any essential change for calcium and sodium, nor incidentally for other ions, such as magnesium, potassium, phosphate, sulphate, chlorite, and nitrate. As the amount of cations remains at the same level at a reduced SCD, it is clear that the SRCC adsorbed anionic species. Whereas for talc the SCD remains at the same level and therefore talc mostly adsorbed uncharged species.

d) Influence of the Minerals on Turbidity, COD, Gravimetry and Thermo Gravimetry The analyses in FIG. 2, FIG. 3 and FIG. 4 are given in absolute values, as the corresponding reference changes between the primary and secondary treatment, i.e. after the first treatment.

Thus, the reference for the first treatment is the TMP filtrate (black bar), and the reference for the second treatment is the TMP filtrate treated once with low surface area talc (black slashed white bar). The difference between the treatment results and the corresponding reference are expressed as percentages.

The turbidity values are shown in FIG. 2. The first treatment of the TMP filtrate with FT-LSSA (second from left) confirms the already before measured values. Also the SRCC treated pulp liquor (middle) confirms the point that SRCC is highly efficient in removing colloidal particles.

With a second FT-LSSA treatment (second from right) it is still possible to remove some of the colloidal species but the efficiency is clearly reduced compared with the first treatment. Finally, when the upper liquid phase from the FT-LSSA treated TMP filtrate is treated again with SRCC (right) the SRCC efficiency is not changing.

The TMP filtrate, which acts as an untreated reference sample, showed a turbidity value of 360 NTU. When the TMP filtrate was treated with the FT-LSSA the turbidity decreased for this first step treatment to 107 NTU. This is a reduction of 70%.

With the additional secondary treatment of this pre-treated pulp liquor with FT-LSSA, the turbidity was again decreased somewhat from 107 NTU to 60 NTU. This is a reduction by 44%.

On the other hand the single treatment with SRCC showed, as before, a high affinity for colloidal particles. The turbidity was almost eliminated, giving a reduction of 98-99%.

When the FT-LSSA pre-treated pulp liquor was treated with the complementary secondary SRCC, the turbidity was again virtually eliminated. This is again a reduction by 95%, and indicates the synergistic effect of the combination.

The COD analysis (FIG. 3) shows the affinity for oxidizable, mostly organic compounds remaining after treatment.

The TMP filtrate was found to consume 4250 mg $O_2$ $dm^{-3}$. When this liquor was treated with FT-LSSA, the value decreased to 3970 mg $O_2$ $dm^{-3}$ (second from left). This is a reduction of about 7%.

The secondary treatment with FT-LSSA did not show any effect on COD.

The SRCC showed also a strong affinity for organic compounds. Only 2230 mg $O_2$ $dm^{-3}$ were determined as remaining after SRCC treatment alone. This is a strong reduction of 48%.

When the FT-LSSA pre-treated pulp liquor was subsequently treated with SRCC, a small amount of organic compounds was removed. The value decreased from 3970 to 3390 mg $O_2$ $dm^{-3}$, which is a decrease of 15%.

FIG. 4 shows the results for the gravimetric analysis in mg residue per 100 $cm^3$ of the upper liquid phase after centrifugation.

The TMP filtrate showed 348 mg per 100 $cm^{-3}$. The FT-LSSA treatment reduced the residue to 310 mg per 100 $cm^{-3}$, which is a reduction of 11%.

The residue was again decreased when the liquor was further treated with FT-LSSA to 290 mg per 100 $cm^{-3}$. This is a reduction of 7%.

In the SRCC treated TMP filtrate a residue of 280 mg $dm^{-3}$ was measured, which is 20% reduction.

After pre-treatment with FT-LSSA followed by SRCC treatment, the gravimetric analysis showed a residue in the upper liquid phase of 271 mg $dm^{-3}$. This corresponds to a reduction of 12.5%.

Figure 5:
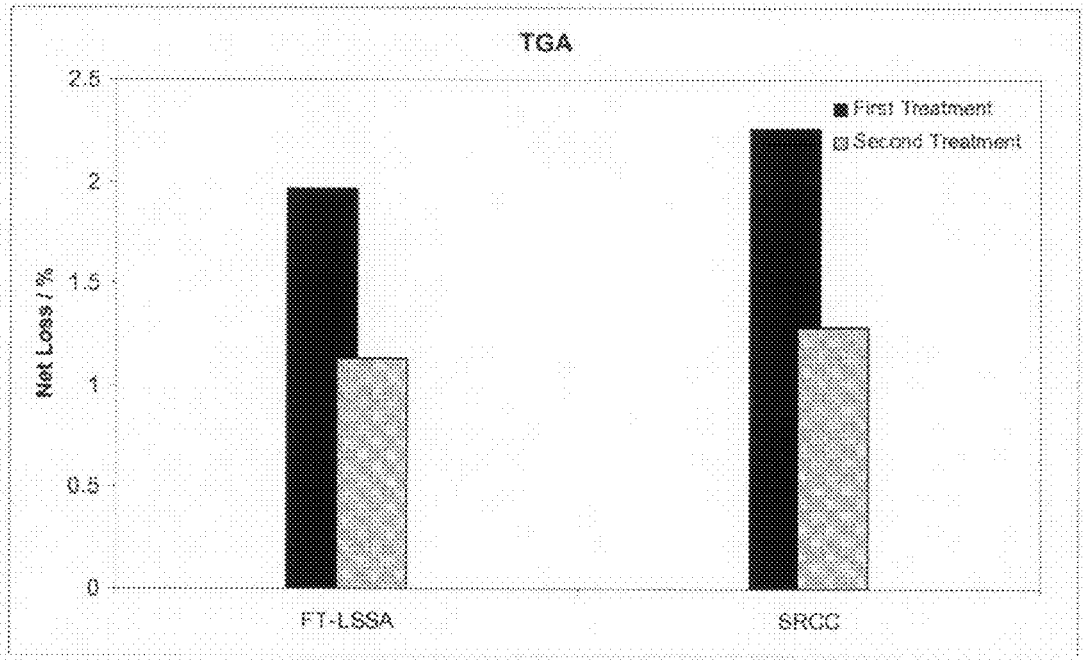
FIG. 5 illustrates the thermo gravimetric analysis given as a net loss in weight % of the lower sedimented mineral phase of a TMP filtrate treated with FT-LSSA or SRCC alone, and with either FT-LSSA or SRCC subsequent to the treatment with FT-LSSA.

Finally, as a check for the other results, the thermo gravimetric analysis is reported in FIG. 5, wherein the lost material of the corresponding mineral from the single treatment is shown in the black bar, and the secondary treatment with each mineral, following talc pre-treatment, as the bright grey bar. Herein, the left black bar represents the result after a single treatment with LSSA. The right bar illustrates the result after a single treatment with SRCC. The left grey bar relates to the results after a first treatment with LSSA and a second treatment with LSSA, whereas the right grey bar illustrates the result of a first treatment with LSSA and a second treatment with SRCC.

The low surface area talc (left black bar) residue after centrifugation loses 2% of volatile material when heated to 1000° C.

When the pre-treated sample was re-treated with FT-LSSA (left grey bar), only a further 1.1% was lost. SRCC had 2.3% material adsorbed on its surface (right black bar). The FT-LSSA pre-treated TMP filtrate, treated further with SRCC, returned that it had only 1.3% material adsorbed in the SRCC residue (right grey bar).

Thus, the effective clarification of particulate material from the sample is favoured by the SRCC, whereas, the organic material pick-up of fine colloidal pitch is favoured by the talc.

Consequently, An especially surface-reacted calcium carbonate has been shown to adsorb readily pitch species in the papermaking environment. Typical pitch control talc appears to have insufficient surface area to cope with all the probable constituents of pulp liquor. Furthermore, talc's pre-selection for lipophilic components means that Coulombic interactions are virtually non-existent. Surface-reacted calcium carbonate or combinations of the polar active surface-reacted calcium carbonate together with non-polar talc provide possibilities for synergistic water system treatments such as for TMP wood pitch.

The invention claimed is:

1. A process for the control of pitch associated with pulp in an aqueous medium comprising pitch, the process comprising (a) contacting the aqueous medium with (i) surface-reacted natural calcium carbonate or (ii) an aqueous suspension comprising surface-reacted natural calcium carbonate having a pH of greater than 6.0 measured at 20° C., to obtain a composite comprising calcium carbonate and pitch, wherein the surface-reacted natural calcium carbonate is a reaction product of natural calcium carbonate with carbon dioxide and one or more acids; and (b) separating the composite from the aqueous medium.

2. The process according to claim 1, wherein the surface-reacted natural calcium carbonate is prepared as an aqueous suspension having a pH of greater than 6.5, measured at 20° C.

3. The process according to claim 1, wherein the surface-reacted natural calcium carbonate is prepared as an aqueous suspension having a pH of greater than 7.0, measured at 20° C.

4. The process according to claim 1, wherein the surface-reacted natural calcium carbonate is prepared as an aqueous suspension having a pH of greater than 7.5, measured at 20° C.

5. The process according to claim 1, wherein the national calcium carbonate is marble, calcite, chalk and dolomite, limestone or mixtures thereof

6. The process according to claim 1, wherein the acid has a $pK_a$ at 25° C. of 2.5 or less.

7. The process according to claim 6, wherein the acid is hydrochloric acid, sulphuric acid, sulphurous acid, hydrosulphate, phosphoric acid, oxalic acid or mixtures thereof.

8. The process according to claim 7, wherein the acid is phosphoric acid.

9. The process according to claim 1, wherein the natural calcium carbonate is reacted with the acid and/or the carbon dioxide in the presence of at least one silicate and/or silica, aluminium hydroxide, earth alkali metal aluminate, magnesium oxide, or mixtures thereof.

10. The process according to claim 9, wherein the at least one silicate is aluminium silicate, calcium silicate or alkali metal silicate.

11. The process according to claim 1, wherein the surface-reacted natural calcium carbonate has a specific surface area of from 5 $m^2/g$ to 200 $m^2/g$, measured using nitrogen and the BET method according to ISO 9277.

12. The process according to claim 1, wherein the surface-reacted natural calcium carbonate has a specific surface area of from 20 $m^2/g$ to 80 $m^2/g$, measured using nitrogen and the BET method according to ISO 9277.

13. The process according to claim 1, wherein the surface-reacted natural calcium carbonate has a specific surface area of from 30 $m^2/g$ to 60 $m^2/g$, measured using nitrogen and the BET method according to ISO 9277.

14. The process according to claim 1, wherein the surface-reacted natural calcium carbonate has a specific surface area of 43 $m^2/g$, measured using nitrogen and the BET method according to ISO 9277.

15. The process according to claim 1, wherein the surface-reacted natural calcium carbonate has a mean grain diameter $d_{50}$ of from 0.1 to 50 μm, measured according to the sedimentation method.

16. The process according to claim 1, wherein the surface-reacted natural calcium carbonate has a mean grain diameter $d_{50}$ of from 0.5 to 25 μm, measured according to the sedimentation method.

17. The process according to claim 1, wherein the surface-reacted natural calcium carbonate has a mean grain diameter $d_{50}$ of from 0.8 to 20 μm, measured according to the sedimentation method.

18. The process according to claim 1, wherein the surface-reacted natural calcium carbonate has a mean grain diameter $d_{50}$ of from 1 to 10 μm, measured according to the sedimentation method.

19. The process according to claim 1, wherein the surface-reacted natural calcium carbonate has a mean grain diameter $d_{50}$ of from 4 to 7 μm, measured according to the sedimentation method.

20. The process according to claim 1, wherein the aqueous suspension of surface-reacted natural calcium carbonate is stabilized with one or more dispersants.

21. The process according to claim 1, wherein the surface-reacted natural calcium carbonate is used in powder form and/or in the form of granules.

22. The process according to claim 1, wherein the surface-reacted natural calcium carbonate is added in an amount of 0.05- 25wt.-%, based on the weight on oven (100° C.) dry fibers added.

23. The process according to claim 1, wherein the surface-reacted natural calcium carbonate is added in an amount of 0.25- 10 wt.-%, based on the weight on oven (100° C.) dry fibers added.

24. The process according to claim 1, wherein the surface-reacted natural calcium carbonate is added in an amount of 0.5- 2 wt.-%, based on the weight on oven (100° C.) dry fibers added.

25. The process according to claim 1, wherein the pH of the aqueous medium comprising pitch is adjusted to a value of >6 prior to the addition of the surface-reacted natural calcium carbonate.

26. The process according to claim 1, wherein the pH of the aqueous medium comprising pitch is adjusted to a value of >6.5 prior to the addition of the surface-reacted natural calcium carbonate.

27. The process according to claim 1, wherein the pH of the aqueous medium comprising pitch is adjusted to a value of >7 prior to the addition of the surface-reacted natural calcium carbonate.

28. The process according to claim 1, wherein the aqueous medium comprises mechanical pulp, ground wood, TMP (thermo mechanical pulp), chemithermo-mechanical pulp (CTMP), chemical pulp, kraft pulp, sulphate pulp, or recycled pulp used in the paper making process.

29. The process according to claim 1, wherein talc is added to aqueous medium comprising pitch.

30. The process according to claim 29, wherein the talc has a purity of >90 weight-%.

31. The process according to claim 29, wherein the talc has a purity of >95 weight-%.

32. The process according to claim 29, wherein the talc has a purity of >97 weight-%.

33. The process according to claim 29, wherein the talc has a purity of >100 weight-%.

34. The process according to claim 29, wherein the talc particles have a $d_{50}$ value of 0.1 to 50 μm, measured according to the sedimentation method.

35. The process according to claim 29, wherein the talc particles have a $d_{50}$ value of 0.2 to 40 μm, measured according to the sedimentation method.

36. The process according to claim 29, wherein the talc particles have a $d_{so}$ value of 0.3 to 30 μm, measured according to the sedimentation method.

37. The process according to claim 29, wherein the talc particles have a $d_{so}$ value of 0.4 to 20 μm, measured according to the sedimentation method.

38. The process according to claim 29, wherein the talc particles have a $d_{so}$ value of 0.5 to 10 μm, measured according to the sedimentation method.

39. The process according to claim 29, wherein the talc particles have a $d_{so}$ value of 1, 7 or 7 μm, measured according to the sedimentation method.

40. The process according to claim 29, wherein the talc has a specific surface area of between 3 and 100 $g/m^2$.

41. The process according to claim 29, wherein the talc has a specific surface area of between 7 and 80 $g/m^2$.

42. The process according to claim 29, wherein the talc has a specific surface area of between 9 and 60 $g/m^2$.

43. The process according to claim 29, wherein the talc has a specific surface area of between 10 and 50 $g/m^2$.

44. The process according to claim 29, wherein the talc has a specific surface area of 30 or 51 $g/m^2$.

45. The process according to claim 29, wherein the talc is added in an amount of 0.05- 25 wt.-%, based on the weight on oven (100° C.) dry fibers.

46. The process according to claim 29, wherein the talc is added in an amount of 0.25- 10 wt.-%, based on the weight on oven (100° C.) dry fibers.

47. The process according to claim 29, wherein the talc is added in an amount of 0.5- 2 wt.-%, based on the weight on oven (100° C.) dry fibers.

48. The process according to claim 1, wherein the aqueous medium is brought into contact with the surface-reacted natural calcium carbonate by surface filtration, depth filtration and/or alluvium filtration.

49. The process according to claim 1, wherein the composite is separated from the aqueous medium by sedimentation or filtration.

50. The process according to claim 1, wherein the composite is separated from the aqueous medium by surface filtration, depth filtration and/or alluvium filtration.

51. The process according to claim 1, wherein the aqueous medium is brought into contact with the surface-reacted natural calcium carbonate and the composite is separated from the aqueous medium by surface filtration, depth filtration and/or alluvium filtration.

* * * * *